US009419335B2

(12) United States Patent
Pintos et al.

(10) Patent No.: US 9,419,335 B2
(45) Date of Patent: Aug. 16, 2016

(54) ELECTROMAGNETIC WAVE PROPAGATION DISRUPTION DEVICE AND METHOD FOR PRODUCING SAME

(71) Applicant: COMMISSARIAT A L'ENERGIE ATOMIQUE ET AUX ENE ALT, Paris (FR)

(72) Inventors: Jean-Francois Pintos, Saint-Blaise-du-Buis (FR); Ossama El Bouayadi, Grenoble (FR)

(73) Assignee: Commissariat a l'energie atomique et aux energies alternatives, Paris (FR)

( * ) Notice: Subject to any disclaimer, the term of this patent is extended or adjusted under 35 U.S.C. 154(b) by 137 days.

(21) Appl. No.: 14/291,322

(22) Filed: May 30, 2014

(65) Prior Publication Data

US 2014/0354502 A1 Dec. 4, 2014

(30) Foreign Application Priority Data

May 31, 2013 (FR) ..... 13 54998

(51) Int. Cl.
*H01Q 1/52* (2006.01)
*H01Q 15/00* (2006.01)

(52) U.S. Cl.
CPC ..... *H01Q 1/525* (2013.01); *H01Q 1/523* (2013.01); *H01Q 1/526* (2013.01); *H01Q 15/008* (2013.01); *H01Q 15/0066* (2013.01); *Y10T 29/4902* (2015.01)

(58) Field of Classification Search
CPC ..... H01Q 1/526; H01Q 1/52; H01Q 1/243; H01Q 17/00; H01Q 1/245
USPC ..... 343/841, 700 MS, 909
See application file for complete search history.

(56) References Cited

U.S. PATENT DOCUMENTS 6,995,733 B2 * 2/2006 Waltho ..... H01Q 1/243 343/700 MS
7,190,315 B2 * 3/2007 Waltho ..... H01Q 1/28 343/705

(Continued)

FOREIGN PATENT DOCUMENTS

| | | | |
|---|---|---|---|
| EP | 2 362 487 | A1 | 8/2011 |
| EP | 2 518 823 | A1 | 10/2012 |
| EP | 2 518 824 | A1 | 10/2012 |
| FR | 2 867 617 | B1 | 9/2005 |
| GB | 2 467 763 | | 8/2010 |

OTHER PUBLICATIONS

French Preliminary Search Report issued Feb. 14, 2014 in French Application 13 54998, filed on May 31, 2013.

(Continued)

*Primary Examiner* — Huedung Mancuso
(74) *Attorney, Agent, or Firm* — Oblon, McClelland, Maier & Neustadt, L.L.P.

(57) ABSTRACT

An electromagnetic wave propagation disruption device with a metamaterial structure including: a plurality of conductive elements arranged on a top face of a substrate; a plurality of interconnection networks electrically interconnecting at least some of these conductive elements, wherein these networks are not electrically connected to each other. At least two of these networks are dimensioned differently to each other, thus involving that distances between interconnected conductive elements are different from one network to another, to generate phase shifts, between the conductive elements interconnected thereby, different from one network to the other. A ground plane with holes is arranged on a bottom face of the substrate and metallic vias are formed in the substrate, each of them including an upper end in contact with a conductive elements and a lower end arranged facing one of the holes of the ground plane, with no electrical contact with the ground plane.

15 Claims, 5 Drawing Sheets

(56) References Cited

U.S. PATENT DOCUMENTS

| | | | | |
|---|---|---|---|---|
| 7,209,082 | B2 * | 4/2007 | Waltho | H05K 1/0216 343/700 MS |
| 8,258,408 | B2 * | 9/2012 | Kim | H05K 1/0236 174/250 |
| 8,330,048 | B2 * | 12/2012 | Cho | H05K 1/0236 174/250 |
| 2005/0134521 | A1 | 6/2005 | Waltho | |
| 2011/0210905 | A1 | 9/2011 | Maruyama et al. | |
| 2012/0098628 | A1 | 4/2012 | Batchelor et al. | |

OTHER PUBLICATIONS

Peter Kovacs et al. "Dispersion Analysis of Planar Metallo-Dielectric EBG Structures in Ansoft HFSS", International Conference on Microwaves, Radar and Wireless Communications, 2008, 4 pages.

Fan Yang et al. "Microstrip Antennas Integrated with Electromagnetic Band-Gap (EBG) Structures: A Low Mutual Coupling Design for Array Applications", IEEE Transactions on Antennas and Propagation, vol. 51, No. 10, 2003, 11 pages.

* cited by examiner z
y
x

12
$v_{1,1}$ ... $v_{1,n/2}$ ...
$e_{1,1}$ ... $e_{1,n/2}$ ...
14
$e_{1,n}$
$e_{i,1}$
$v_{i,1}$
$e_{m,1}$
$v_{1,n}$
$e_{i,n}$
$v_{i,n}$
$e_{m,n}$
$v_{m,1}$
$v_{m,n}$
18
20
ϕ1
16
22
ϕ2
10
24
ϕn/2

12
z
y
x
$e'_{1,1}$
26
$e_{1,1}$
$v'_{1,1}$
$v_{1,1}$
26
26
$e_{1,n}$
$e'_{1,n}$
$v'_{1,n}$
$v_{1,n}$
$e_{m,1}$
$v_{m,1}$
$e'_{m,1}$
$v'_{m,1}$
$e'_{m,n}$
$v'_{m,n}$
$e_{m,n}$
$v_{m,n}$

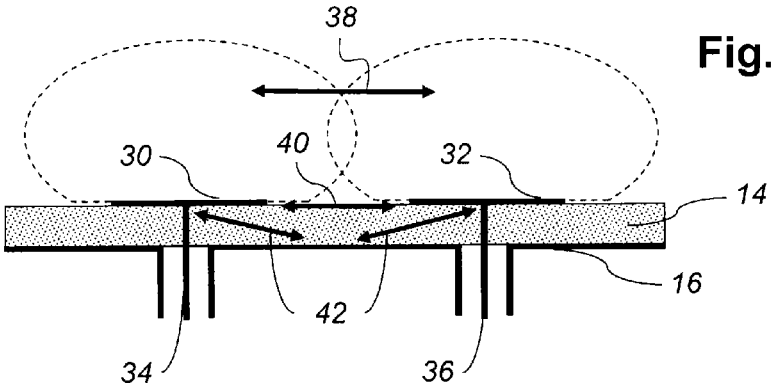
Fig.5
Fig.6
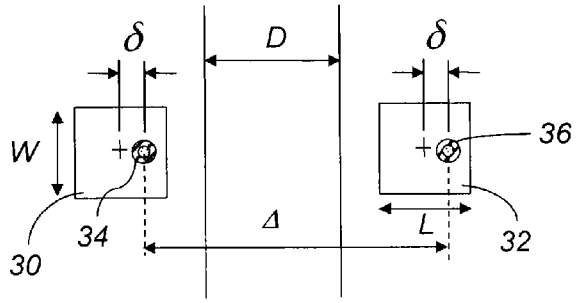
Fig.7
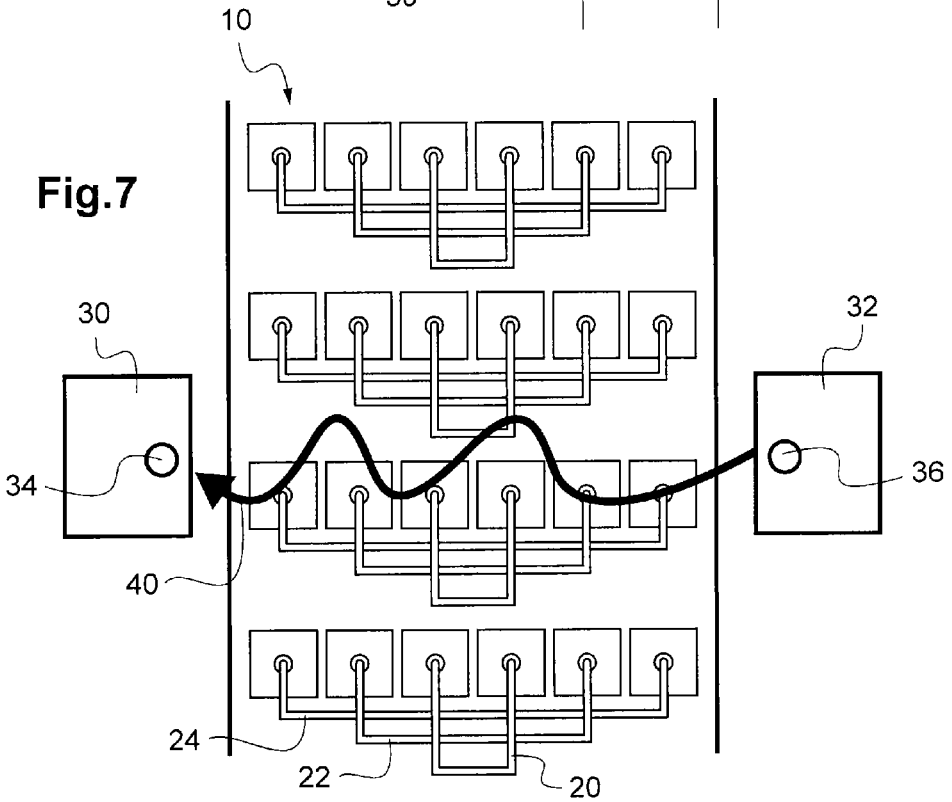

ELECTROMAGNETIC WAVE PROPAGATION DISRUPTION DEVICE AND METHOD FOR PRODUCING SAME

The present invention relates to an electromagnetic wave propagation disruption device. It also relates to a method for producing this device.

BACKGROUND OF THE INVENTION

The invention applies more particularly to an electromagnetic wave propagation disruption device with a metamaterial structure comprising:

- a plurality of conductive elements separated from each other and arranged on a substrate,
- a plurality of interconnection networks electrically interconnecting at least some of these conductive elements, these interconnection networks not necessarily being electrically connected to each other.

The use of antennas in communication, monitoring or satellite navigation systems is inescapable. However, in this type of system, the space available for these devices is reduced and involves a need for antenna miniaturization.

Due to the reduced size thereof, planar antennas are good candidates for this type of system. As a general rule, a planar antenna comprises a radiant conductive surface, for example square, separated from a conductive reflective plane or ground plane by a substrate.

A planar antenna may be used alone or as an element of an antenna array. In order to reduce the size of an antenna array, it is necessary to reduce the distance between the radiant surfaces thereof. However, this increases the coupling level between these radiant surfaces. Also, this coupling significantly degrades antenna performances, giving rise to a loss of efficiency, antenna polarization degradation problems or asymmetry in the radiation pattern thereof.

Of the various types of waves that can be propagated from a planar antenna giving rise to coupling between the radiant surfaces of the antenna array, a distinction may be made between: spatial waves diffracted by the edges of the radiant surfaces, surface waves between the substrate and the air and surface waves guided by the substrate. Furthermore, a dielectric substrate placed between the radiant surface of a planar antenna and the ground plane promotes coupling by surface waves which may be particularly troublesome.

Due to the special electromagnetic properties thereof, metamaterials have found a large number of applications in the field of antennas. In particular, of the various existing metamaterial structures, "Electromagnetic Band Gap" (EBG) structures make it possible to reduce the coupling level between antennas in an array. Indeed, this type of EBG structure has the property of preventing the propagation of waves in a so-called frequency band gap. In this way, when such EBG structures are inserted between the radiant surfaces of an antenna array, they particularly prevent the propagation of surface waves from one antenna to another helping reduce the coupling level between these antennas.

DESCRIPTION OF THE PRIOR ART

The article by Yang et al., entitled "Microstrip antennas integrated with electromagnetic band-gap (EBG) structures: a low mutual coupling design for array applications", published in IEEE Transactions on Antennas and Propagation, volume 51, number 10, October 2003, proposes the use of a "mushroom" type EBG structure placed between two planar antennas and demonstrates that this structure is capable of reducing coupling between the antennas in the electromagnetic band gap of this EBG structure.

According to this article, a so-called "mushroom" type EBG structure comprises, generally, a periodic set of EBG type conductive elements separated from each other, printed on a dielectric substrate and connected to a ground plane by means of a set of metallic vias formed in the dielectric substrate. The electrical behavior of this type of EBG structure subjected to an electromagnetic wave may be modeled according to an LC resonant circuit. Indeed, when an electromagnetic wave interacts with the surface of the conductive elements, it gives rise to an accumulation of charges at the edge of the surface of these conductive elements and a current loop is established between two of these conductive elements by means of the metallic vias. In this way, an inductance (L) results from the current flowing through the metallic vias and a capacitance (C) results from the accumulation of charges between the conductive elements. It is well-known to those skilled in the art that the resonance frequency $f_r$ of an LC circuit is proportional to the expression: $1/\sqrt{LC}$, and that the bandwidth BW associated with this resonance frequency $f_r$ is proportional to the expression: $\sqrt{L/C}$. In this way, according to this LC resonant circuit model, this type of EBG structure acts as a band-stop filter of the incident waves at this resonance frequency.

The authors propose an experimental method for characterizing the band gap of a "mushroom" type EBG structure with more precision than the LC model, subsequently demonstrating that surface wave suppression only takes place when the propagation frequency of these surface waves is situated in the frequency band gap of the EBG structure.

Finally, after carrying out a comparison of the performances of EBG structures with other techniques well known to those skilled in the art also enabling surface wave suppression, the authors have demonstrated that, of these techniques, EBG type structures have the best results in respect of reducing coupling between antennas.

Nevertheless, the band gap of a "mushroom" type EBG structure is dependent on a number of parameters inherent to the structure, for example the size and number of conductive elements, the type of substrate, the dimensions of the substrate, etc. These parameters being defined during the design of the EBG structure, it is not easy to envisage the modification of the behavior of this type of structure after the production thereof.

In the patent published under the number FR 2 867 617 B1, an example of an embodiment of a metamaterial suitable for modifying the filtering properties thereof is proposed. This metamaterial is made from transverse conductive elements formed from metallic islands in a dielectric matrix, for example a polymer foam. The aim is to produce a 3D network of conductive elements suitable for disrupting electromagnetic wave propagation in a predetermined manner. In this way, by overlaying a plurality of layers of conductive elements wherein at least one layer comprises transverse conductive elements, the filtering properties of such a volume structure of conductive elements may be predetermined. These transverse conductive elements may be transverse dipoles. They may also form open or closed transverse loops, using one or two conductive tracks connecting one or both ends of the two transverse conductive elements to each other.

In order to be able to connect the layers to each other, connections using passive components or active components, for example PIN diodes, suitable for interconnecting two adjacent conductive elements to each other, may be used.

However, this structure is merely suitable for interconnecting two adjacent conductive elements. Given that the distance between two adjacent conductive elements is constant, the phase shift generated therebetween during the connection thereof is identical for all the pairs of elements connected in this way.

When interconnections based on PIN diodes are used, they are merely used as switches. In this case, a control logic is used to modify the polarization of these active components and consequently break or make connections between the conductive elements.

Furthermore, this type of 3D metamaterial structure is not optimal in respect of size when used in a planar antenna array or in any system wherein a compact size of the devices is sought.

It may thus be sought to provide an electromagnetic wave propagation disruption device suitable for doing away with at least some of the problems and constraints mentioned above.

SUMMARY OF THE INVENTION

The invention thus relates to an electromagnetic wave propagation disruption device with a metamaterial structure comprising:

- a plurality of conductive elements separated from each other and arranged on a substrate,
- a plurality of interconnection networks electrically interconnecting at least some of these conductive elements, these interconnection networks not being electrically connected to each other, wherein at least two of these interconnection networks are dimensioned differently to each other to generate phase shifts, between the conductive elements interconnected thereby, different from one of these interconnection networks to the other.

By means of the invention, a novel way to modify the behavior of a metamaterial is proposed. More specifically, an additional setting is proposed, this setting being extrinsic to the metamaterial structure. Indeed, by interconnecting the conductive elements of the metamaterial to each other using a plurality of electrically insulated networks, phase shifts are created between the electrically connected conductive elements and it was surprisingly observed that an optimal combination of at least two different phase shifts between elements from one network to another makes it possible to reduce coupling between planar antennas positioned around a metamaterial of this type further. This results in superior efficiency of these metamaterials, particularly but not merely when they are used as an EBG structure.

Unlike the prior art cited above, where the distances between the interconnected conductive elements are identical, the invention requires by the dimensioning of the interconnection networks that at least two of these distances are different to enable this optimal combination of different phase shifts.

This type of phase shift setting of interconnection networks by dimensioning same differently makes it possible to set the resonance frequency of the metamaterial without increasing the size thereof. Furthermore, it is not only suitable for any type of metamaterial structure, for example, homogeneous, non-homogeneous, planar, volume or other, but it is also easy to produce in industrial form regardless of the metamaterial technology, for example printed circuits, waveguides, coaxial lines, etc.

Optionally, at least some of said interconnected networks are equipped with adjustable phase shift devices for connecting the conductive elements to each other.

In this way, with the use of active elements such as adjustable phase shift devices, for example diodes, during the interconnection of the conductive elements to each other, it becomes possible to adjust the phase shifts according to the application to be optimized merely by setting these active elements while retaining the structure of the metamaterial and without affecting the established dimensioning of the interconnection networks.

Also optionally, the conductive elements are distributed on the substrate in an array along m rows and n columns, n being an even number, each interconnection network interconnecting two conductive elements of the same i-th row positioned on the $$\left(\frac{n}{2}-j\right)\text{-th and }\left(\frac{n}{2}+1+j\right)\text{-th}$$

columns, where, for each interconnection network, i adopts one of the values from the range [1, m] and j one of the values from the range $$\left[0, \frac{n}{2}-1\right].$$

Advantageously, the substrate comprises a top face and a bottom face, the plurality of conductive elements being positioned on the top face of the substrate, the metamaterial structure further comprising:

- a ground plane positioned on the bottom face of the substrate with holes formed in this ground plane,
- a set of metallic vias formed in the substrate and passing through the entire thickness thereof, each of these metallic vias comprising an upper end in contact with one of the conductive elements and a lower end arranged facing one of the holes of the ground plane, with no electrical contact with the ground plane.

Also optionally, the lower ends of the metallic vias in contact with the interconnected conductive elements form access ports to power supply points to which the interconnection networks are connected.

Also optionally, the metamaterial structure comprises two overlaid layers of conductive elements arranged on a top face of the substrate, each of these layers comprising a plurality of conductive elements separated from each other and distributed in an array along m rows and n columns, these two layers being separated from each other along a perpendicular direction to the top face of the substrate by a predetermined distance, the conductive elements of the first layer being arranged in a staggered fashion relative to the conductive elements of the second layer so as to increase the capacitive effect of the cell.

Also optionally, each of the conductive elements has any of the shapes of the set consisting of a square shape, a rectangular shape, a spiral shape, a fork shape, a Jerusalem cross shape and a dual Jerusalem cross shape known as a UC-EBG shape.

Also optionally, said plurality of interconnection networks has any of the topologies from the set consisting of a linear topology, a star topology, a radial topology and a tree topology.

The invention also relates to an electromagnetic wave transmission/receiving system comprising at least two antennas between which at least one electromagnetic wave propagation disruption device according to the invention is arranged.

The invention also relates to a method for producing an electromagnetic wave propagation disruption device with a metamaterial structure comprising the following steps:

arranging a plurality of conductive elements separated from each other on a substrate, electrically interconnecting at least some of these conductive elements using a plurality of interconnection networks, these interconnection networks not being electrically connected to each other, further comprising a step for dimensioning the interconnection networks, wherein at least two of these interconnection networks are dimensioned differently to each other to generate phase shifts, between the conductive elements interconnected thereby, different from one of these interconnection networks to the other.

BRIEF DESCRIPTION OF THE DRAWINGS

The invention will be understood more clearly using the following description, given merely as an example and with reference to the appended figures wherein:

FIG. 5 is a sectional view of an example of a transmission/receiving system with two antennas, FIG. 6 is a schematic top view of the transmission/receiving system in FIG. 5, FIG. 7 is a schematic top view of the transmission/receiving system in FIG. 5 further comprising an electromagnetic wave propagation disruption device, according to one embodiment of the invention.

DESCRIPTION OF THE PREFERRED EMBODIMENTS

Figure 1:
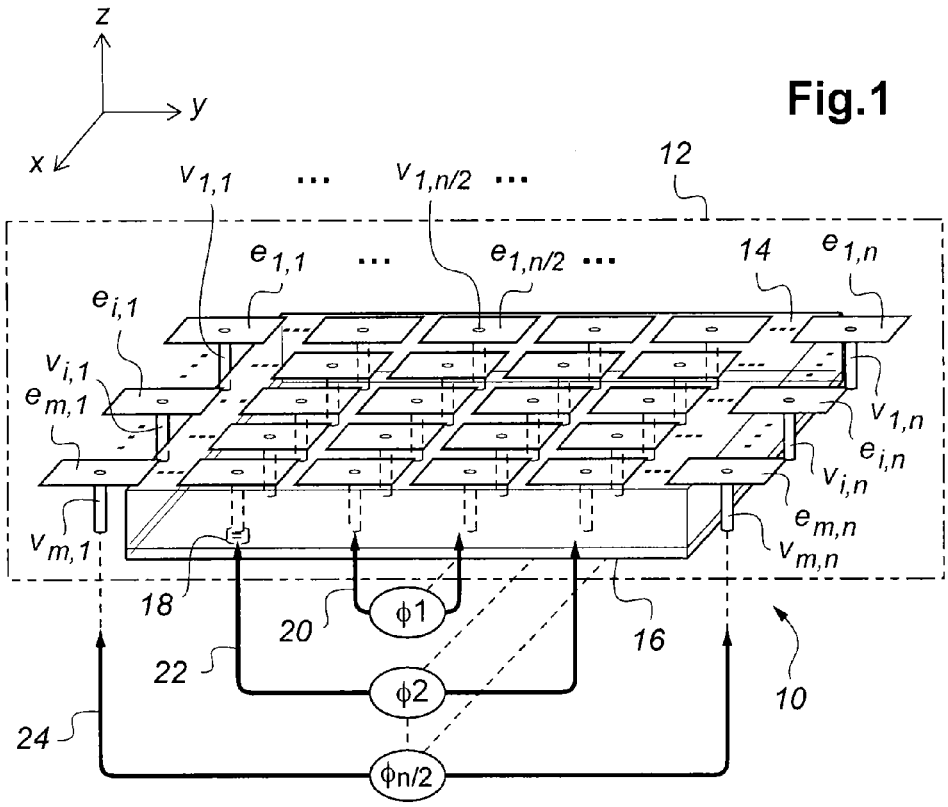
FIG. 1 represents a sectional perspective view of the overall structure of an electromagnetic wave propagation disruption device, according to one embodiment of the invention.

FIG. 1 represents a sectional perspective view of the overall structure of an electromagnetic wave propagation disruption device 10 with a metamaterial structure 12, according to one possible embodiment of the invention. This device may for example be positioned between two elements of a planar antenna defined on the same substrate to limit the surface waves between these two elements.

In this embodiment, the metamaterial structure 12 is of the mushroom type and comprises a plurality of conductive elements $e_{1,1}, \ldots, e_{i,j}, \ldots, e_{m,n}$ in a rectangular shape, separated from each other and arranged on a top face of a substrate 14 made, for example, of dielectric material. This substrate may be an epoxy-based insulating material, an insulating material well known to those skilled in the art, for example FR4 type with a relative permittivity value $\epsilon_R$ of approximately 4.4. The conductive elements $e_{1,1}, \ldots, e_{i,j}, \ldots, e_{m,n}$ are distributed on the substrate 14 in an array of m rows and n columns along two main orthogonal directions annotated y and x. In this way, each row of conductive elements, for example the first row, comprises n conductive elements along the direction x ($e_{1,1}, \ldots, e_{1,j}, \ldots, e_{1,n}$, for this first row) and each column of conductive elements, for example the last column, comprises m conductive elements along the direction y ($e_{1,n}, \ldots, e_{i,n}, \ldots, e_{m,n}$, for this last column). A ground plane 16 is positioned on a bottom face of the substrate 14 with holes 18 formed in this ground plane 16 and arranged opposite the conductive elements along a direction z orthogonal to the plane (x, y). For the purpose of clarity, a single hole 18 is shown in FIG. 1, but the ground plane 16 actually comprises the same number of holes 18 as conductive elements $e_{1,1}, \ldots, e_{i,j}, \ldots, e_{m,n}$.

The electromagnetic wave propagation disruption device 10 further comprises a set of metallic vias $v_{1,1}, \ldots, v_{i,j}, \ldots, v_{m,n}$ formed in the substrate 14. These metallic vias $v_{1,1}, \ldots, v_{i,j}, \ldots, v_{m,n}$ pass through the entire thickness of the substrate 14. The upper end of each of these metallic vias, for example the via $v_{i,j}$, is in contact with one of the conductive elements, in this instance the conductive element for the via $v_{i,j}$. The lower end of each of these metallic vias is arranged facing one of the holes 18 of the ground plane 16, with no electrical contact with the ground plane 16, enabling the conductive elements to make electrical connections outside the metamaterial structure 12. By way of example, the conductive element $e_{1,1}$ may be electrically connected to the conductive element $e_{1,n}$ using a transmission line connecting the lower ends of the respective vias $v_{1,1}$ and $v_{1,n}$ thereof.

According to the particular embodiment in FIG. 1, the conductive elements $e_{1,1}, \ldots, e_{i,j}, \ldots, e_{m,n}$ are electrically interconnected in pairs, along a preferred direction, that of the axis y, using a plurality of interconnection networks, these interconnection networks not being electrically connected to each other. For the purpose of clarity, only some of the interconnection networks in the last row m are represented in FIG. 1 by the references 20, 22, 24, but all the rows of conductive elements also comprise interconnection networks.

In this way, according to this embodiment, each interconnection network connects two conductive elements from the same i-th row positioned on the $$\left[0, \frac{n}{2} - 1\right].$$

columns, where, for each interconnection network, i adopts one of the values from the range [1, m] and j one of the values from the range $$\left(\frac{n}{2} - j\right)\text{-th and } \left(\frac{n}{2} + 1 + j\right)\text{-th}$$

In this way, the interconnection network 20 illustrated in FIG. 1 connects the two elements $e_{m,n/2}$ and $e_{m,n/2+1}$ positioned at the center of the m-th and last row, the interconnection network 22 then connects the next two elements $e_{m,n/2-1}$, $e_{m,n/2+2}$ to each other. The other conductive elements of the m-th and last row are interconnected in the same way in pairs step by step up to the interconnection network 24 connecting the first element $e_{m,1}$ and the last element $e_{m,n}$ of the m-th and last row.

As mentioned above, the interconnection networks of the conductive elements $e_{1,1}, \ldots, e_{i,j}, \ldots, e_{m,n}$ may consist of transmission lines. It is known to those skilled in the art that an equivalent first-order model characterizes a transmission line by a phase shift wherein the value is dependent on the length of this transmission line.

Consequently, a linear topology of interconnection networks such as that described above is suitable for generating different phase shifts $\Phi_1, \Phi_2, \ldots, \Phi_{n/2}$ between the conductive elements interconnected by the interconnection networks 20, 22, 24 (and the others not shown) since the lengths of these interconnection networks consisting of transmission lines are different.

It should be noted that, in this embodiment, n is necessarily an even number, suitable for connecting all the elements from a row to each other in pairs. However, in further alternative embodiments, some conductive elements among the n conductive elements $e_{i,1}, \ldots, e_{i,j}, \ldots, e_{i,n}$ of any row i of the metamaterial may not be electrically interconnected to each other or may be interconnected in more than pairs by the interconnection network.

Also, in this embodiment, an identical linear topology of the interconnection networks is applied to all the rows of the metamaterial structure 12. Nevertheless, in further alternative embodiments, the linear topology of the interconnection networks may be different from one row to another of this structure.

Furthermore, the conductive elements $e_{1,1}, \ldots, e_{i,j}, \ldots, e_{m,n}$ of the metamaterial structure 12 may be electrically interconnected according to various interconnection network topologies, particularly different to a linear topology. They may, for example, be interconnected according to a star topology or a radial topology or a tree topology.

As a general rule, according to the invention, regardless of the selected topology for interconnecting the conductive elements, at least two of these interconnection networks are dimensioned differently to each other to generate phase shifts, between the conductive elements interconnected thereby, different from one of these interconnection networks to the other.

Moreover, in further possible embodiments, the conductive elements may have different shapes to the rectangular shape illustrated in FIG. 1. The design of conductive elements in a square, spiral, fork, Jerusalem cross or dual Jerusalem cross shape referred to as a UC-EBG shape is well known to those skilled in the art as detailed in the article by Kovacs et al, entitled "Dispersion analysis of planar metallo-dielectric EBG structures in Ansoft HFSS", published for the "17th International Conference on Microwaves, Radar and Wireless Communications", May 19-21, 2008.

Figure 2:
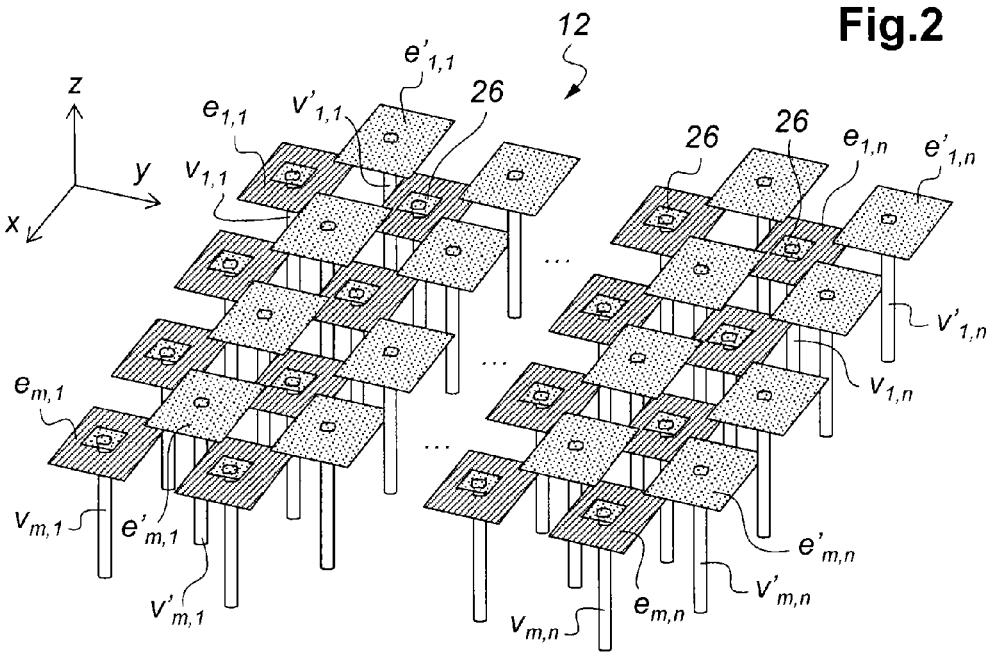
FIG. 2 represents a perspective view of an example of an arrangement of a plurality of conductive elements of an electromagnetic wave propagation disruption device, according to one preferred embodiment of the invention.

FIG. 2 represents a perspective view of an example of preferred arrangement of the conductive elements of the metamaterial structure 12 of the electromagnetic wave propagation disruption device 10. More specifically, this preferred arrangement comprises two vertically overlaid layers of conductive elements (the vertical being defined by the direction z) arranged on the top face of the substrate 14.

Overlaying layers of conductive elements makes it possible to increase the capacitive effect of the metamaterial structure 12 by enabling a partial overlap of the conductive elements of these layers, thus rendering the resonance frequency $f_r$ of this structure independent of the size of the conductive elements. On the other hand, the resonance frequency $f_r$ tends to become dependent on the number of conductive elements.

As in the embodiment described above, each of these two layers comprises a plurality of conductive elements in a rectangular shape separated from each other and distributed in an array along m rows and n columns. These two layers are separated from each other by a predetermined distance along the direction z. The conductive elements $e_{1,1}, \ldots, e_{i,j}, \ldots, e_{m,n}$ of the first layer are offset from the conductive elements $e'_{1,1}, \ldots, e'_{i,j}, \ldots, e'_{m,n}$ of the second layer along the two main directions x and y of the top face of the substrate 14 not parallel with each other. In other words, the conductive elements $e_{1,1}, \ldots, e_{i,j}, \ldots, e_{m,n}$ of the first layer are arranged in a staggered fashion relative to the conductive elements $e'_{1,1}, \ldots, e'_{i,j}, \ldots, e'_{m,n}$ of the second layer, partially covering same.

Each of the conductive elements of each layer is connected to a metallic via. In this way, the plurality of conductive elements $e_{1,1}, \ldots, e_{i,j}, \ldots, e_{m,n}$ of the first layer is connected to a plurality of metallic vias $v_{1,1}, \ldots, v_{i,j}, \ldots, v_{m,n}$ formed in the substrate 14 and the plurality of conductive elements $e'_{1,1}, \ldots, e'_{i,j}, \ldots, e'_{m,n}$ of the second layer is connected to a plurality of metallic vias $v'_{1,1}, \ldots, v'_{i,j}, \ldots, v'_{m,n}$ also formed in the substrate 14.

The metallic vias in contact with the conductive elements of both layers are all of the same size and all pass through the layers of the metamaterial structure 12, particularly the two layers of conductive elements, the substrate 14 and the ground plane 16. Conductive tracks 26 are positioned in the same plane as the conductive elements $e'_{1,1}, \ldots, e'_{i,j}, \ldots, e'_{m,n}$ of the second layer which is the higher of the two layers of conductive elements on top of the substrate 14, so as to cover the upper end of the metallic vias $v_{1,1}, \ldots, v_{i,j}, \ldots, V_m$, in contact with the conductive elements $e_{1,1}, \ldots, e_{i,j}, \ldots, e_{m,n}$ of the first layer. These square conductive layers 26 are arranged separately from each other and from the conductive elements $e'_{1,1}, \ldots, e'_{i,j}, \ldots, e'_{m,n}$ of the second layer. They are arranged in an array along the m rows and n columns mentioned above.

Figure 3:
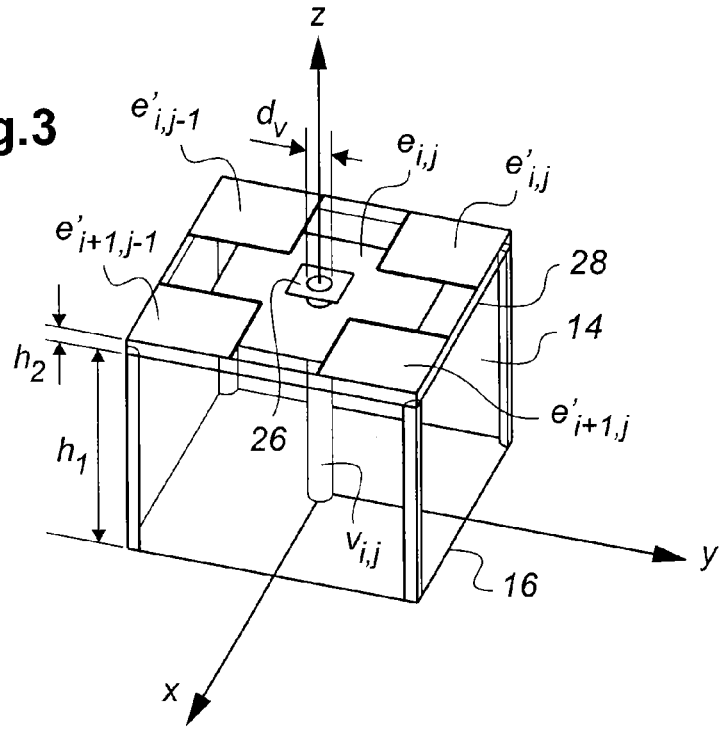
FIG. 3 represents a sectional perspective view of a basic cell of the plurality of conductive elements in FIG. 2.

FIG. 3 represents a sectional perspective view of a basic cell of the plurality of conductive elements in FIG. 2. This basic cell comprises at the center thereof a conductive element $e_{i,j}$ belonging to the first layer of conductive elements situated at a height $h_1$, for example approximately 2.5 mm, of the ground plane 16. Four adjacent conductive elements $e'_{i,j-1}, e'_{i,j}, e'_{i+1,j}$, belonging to the second layer of conductive elements, this layer being separated by a distance $h_2$ from the first layer along the direction z, for example approximately 0.2 mm, are arranged on top of this conductive element $e_{i,j}$ and in a staggered fashion so as to partially cover same. These four adjacent conductive elements are represented partially in this basic cell in FIG. 3.

Between the two layers of conductive elements, an insulating material 28 is inserted, for example a dielectric material of the FR4 type and having a relative permittivity $\epsilon_R$=4.4. Obviously, alternative embodiments may be envisaged with other types of insulating material or without insulating material.

The portion of each conductive element $e'_{i,j-1}, e'_{i,j}, e'_{i+1,j-1}, e'_{i+1,j}$ covering the conductive element $e_{i,j}$ is determined according to the size of this conductive element $e_{i,j}$ and that of the conductive track 26 thereof. The resulting capacitive effect of a basic cell thus increases with the closing of the conductive elements of the same layer and the overlay ratio between the conductive elements of different layers. Nevertheless, all the conductive elements $e_{1,1}, \ldots, e_{i,j}, \ldots, e_{m,n}, e'_{1,1}, \ldots, e'_{i,j}, \ldots, e'_{m,n}$ should remain separated from each other and the conductive tracks 26.

The inductive effect of a basic cell is determined by metallic vias passing therethrough and is dependent on the value of the dimensions thereof. The diameter $d_v$ of any metallic via $v_{i,j}$ is for example approximately 0.3 mm and the length thereof 2.7 mm.

According to one alternative embodiment, the metallic vias $v_{1,1}, \ldots, v_{i,j}, \ldots, v_{m,n}$ in contact with the conductive elements $e_{1,1}, \ldots, e_{i,j}, \ldots, e_{m,n}$ of the first layer may be blind metallic vias. In this case, the conductive tracks 26 are no longer necessary. Indeed, with this type of blind vias, well known to those skilled in the art, the blind upper end of each of the metallic vias $v_{1,1}, \ldots, v_{i,j}, \ldots, v_{m,n}$ is in direct contact with each of the conductive elements $e_{1,1}, \ldots, e_{i,j}, \ldots, e_{m,n}$ and does not extend beyond the first layer.

Figure 4:
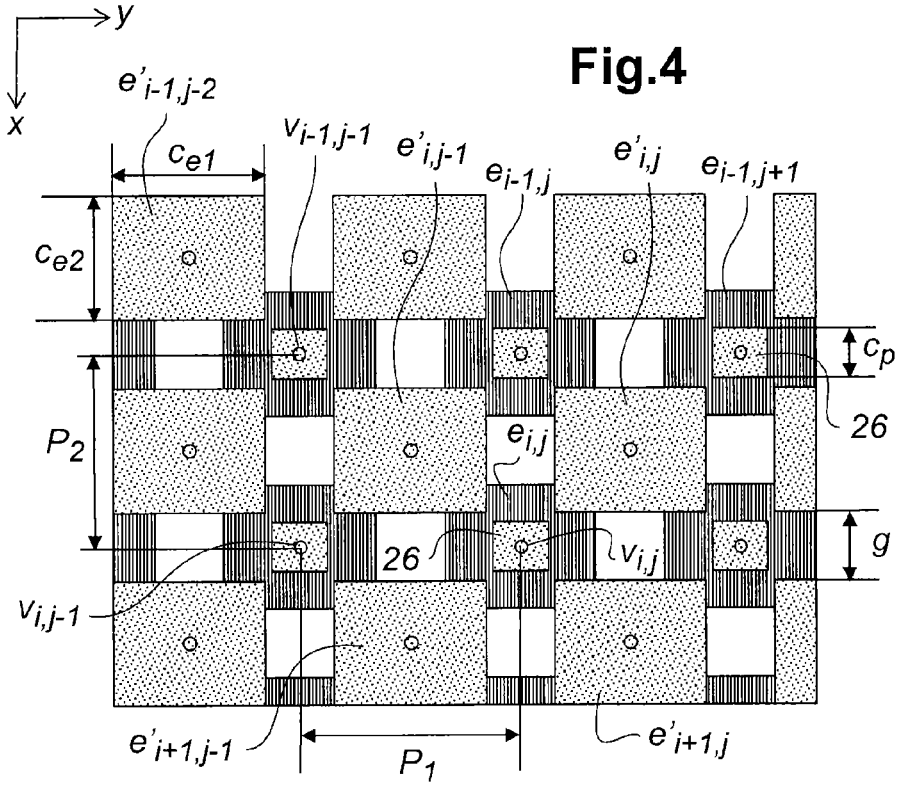
FIG. 4 is a partial top view of the set of conductive elements in FIG. 2.

FIG. 4 is a partial top view of the set of conductive elements in FIG. 2. More specifically, it is used to show, by way of example, the dimensions of the rectangular conductive elements in FIG. 2 and the distances between these elements.

In this example of application, all the conductive elements $e_{1,1}, \ldots, e_{i,j}, \ldots, e_{m,n}$ and $e'_{1,1}, \ldots, e'_{i,j}, \ldots, e'_{m,n}$ of the two layers have the same dimensions, the length $e_{e1}$ along the axis y of any of the conductive elements being approximately 2 mm and the width $c_{e2}$ along the axis x being approximately 1.5 mm. The metallic vias are positioned at the center of these conductive elements. The upper ends of the metallic vias in contact with the conductive elements of the first layer are connected to the square conductive tracks 26. The side, $c_p$, of any of these conductive tracks 26 measures approximately 0.64 mm.

The distance g between two conductive elements of the same layer is 1 mm, thus leaving sufficient space between any of the conductive tracks 26 and the four adjacent coplanar conductive elements, for example $e'_{i,j-1}$, $e'_{i,j}$, $e'_{i+1,j-1}$, $e'_{i+1,j}$ for the conductive track 26 situated on top of the conductive element $e_{i,j}$. The distance $P_1$ between two vias of the same layer along the direction y is approximately 3 mm and the distance $P_2$ between two vias along the direction x is approximately 2.5 mm.

FIG. 5 illustrates an example of an electromagnetic wave transmission/receiving system comprising two planar antennas. More specifically, it illustrates a sectional view of a transmission/receiving system comprising two planar antennas 30 and 32 arranged side by side in a coplanar fashion on a substrate such as the substrate 14. Each planar antenna 30 or 32 comprises a square radiant conductive surface separated from the ground plane 16 by the substrate 14 and the excitation means 34 and 36, particularly coaxial probes, for the power supply of the planar antennas 30 and 32 respectively. These coaxial probes pass through the ground plane 16 with no electrical contact therewith via two holes formed therein.

FIG. 5 further illustrates three types of waves capable of generating coupling phenomena using any one of the two antennas 30 and 32: spatial waves 38 radiated by the square radiant conductive surfaces of the planar antennas 30 and 32, surface waves 40 between the substrate 14 and the air and surface waves 42 guided by the substrate 14 between the two planar antennas 30 and 32. These waves 38, 40, 42 may cause coupling between the antennas of the transmission/receiving system thus degrading the performances thereof.

FIG. 6 is a top view of the transmission/receiving system in FIG. 5. In this example of an embodiment and as mentioned above, the radiant conductive surfaces of the planar antennas 30 and 32 have a square shape, each side L, W measuring approximately 11.5 mm. Obviously, in further alternative embodiments, they may have a different shape, for example rectangular with a different length L and width W. The excitation means 34 and 36 are positioned at a distance δ of approximately 2.5 mm from the center of each of the radiant conductive surfaces of the planar antennas 30 and 32 respectively.

The distance Δ between the excitation means 34 and 36 of the two planar antennas 30 and 32 is approximately $0.6\lambda_0$ where $\lambda_0=c/f$, where c is a constant representing the speed of light in a vacuum and f corresponds to the system operating frequency.

In this way, this transmission/receiving system being dimensioned for use around a frequency of approximately 5.5 GHz, the value of the distance Δ is approximately 32.7 mm. Between the two planar antennas 30 and 32, a zone having a width D of approximately 14.75 mm is reserved for inserting the device 10 with a metamaterial structure 12 thus making it possible to reduce the coupling level between these antennas.

FIG. 7 is a top view of the transmission/receiving system illustrated in FIGS. 5 and 6 further comprising the disruption device 10 according to the invention arranged between the planar antennas 30 and 32 in the zone having the width D. The metamaterial structure 12 is in this case a mushroom type structure comprising for example, according to the preferred embodiment in FIG. 2, two layers of conductive elements $e_{1,1}, \ldots, e_{i,j}, \ldots, e_{4,6}$ and $e'_{1,1}, \ldots, e'_{i,j}, \ldots, e'_{4,6}$, each layer comprising four rows of six conductive elements each. For the purpose of clarity, a single layer of conductive elements of the disruption device 10 is represented in FIG. 7.

These conductive elements $e_{1,1}, \ldots, e_{i,j}, \ldots, e_{4,6}$ and $e'_{1,1}, \ldots, e'_{i,j}, \ldots, e'_{4,6}$ are connected to the same number of metallic vias $v_{1,1}, \ldots, v_{i,j}, \ldots, v_{4,6}$ and $v'_{1,1}, \ldots, v'_{i,j}, \ldots, v'_{4,6}$ wherein the free lower ends form access ports to power supply points. These power supply points enable the interconnection of the conductive elements $e_{1,1}, \ldots, e_{i,j}, \ldots, e_{4,6}$ and $e'_{1,1}, \ldots, e'_{i,j}, \ldots, e'_{4,6}$ of each layer using a plurality of interconnection networks.

The topology of these interconnection networks being of the linear type detailed above, for each layer, the six conductive elements $e_{i,1}, e_{i,2}, e_{i,3}, e_{i,4}, e_{i,5}, e_{i,6}$ from the same row i are interconnected to each other in pairs, starting with the two conductive elements positioned at the center of the row, $e_{i,3}$ and $e_{i,4}$, using for example a transmission line such as the interconnection 20 illustrated in FIG. 1. Then, the interconnection of the two adjacent elements $e_{i,2}$ and $e_{i,5}$ thereof is carried out using a transmission line such as the interconnection 22 illustrated in FIG. 1. Finally, the two conductive elements positioned at the ends of the row, $e_{i,1}$ and $e_{i,6}$,, are interconnected using a transmission line such as the interconnection 24 illustrated in FIG. 1. The same interconnection network topology is repeated for each of the four rows of each layer.

Given that the three transmission lines 20, 22 and 24 each connecting a pair of conductive elements to each other are insulated from each other and have different lengths, they make it possible to generate different phase shifts between the conductive elements.

In this way, this particular embodiment enables three adjustable phase shifts $\Phi_1$, $\Phi_2$, $\Phi_3$ different to each other on each line. An optimal combination of values of these phase shifts $\Phi_1$, $\Phi_2$, $\Phi_3$ makes it possible to optimize the decoupling of the planar antennas 30 and 32 positioned around this disruption device 10. By way of example, for the transmission/receiving system in FIG. 7 and with the dimensions specified with reference to FIG. 6, a value of the phase shifts ($\Phi_1$, $\Phi_2$, $\Phi_3$)=(300°, 300°, 45°) makes it possible to minimize the coupling between the antennas 30 and 32 when operating at a frequency of 5.5 GHz by preventing the transmission of surface waves 40.

Figure 8:
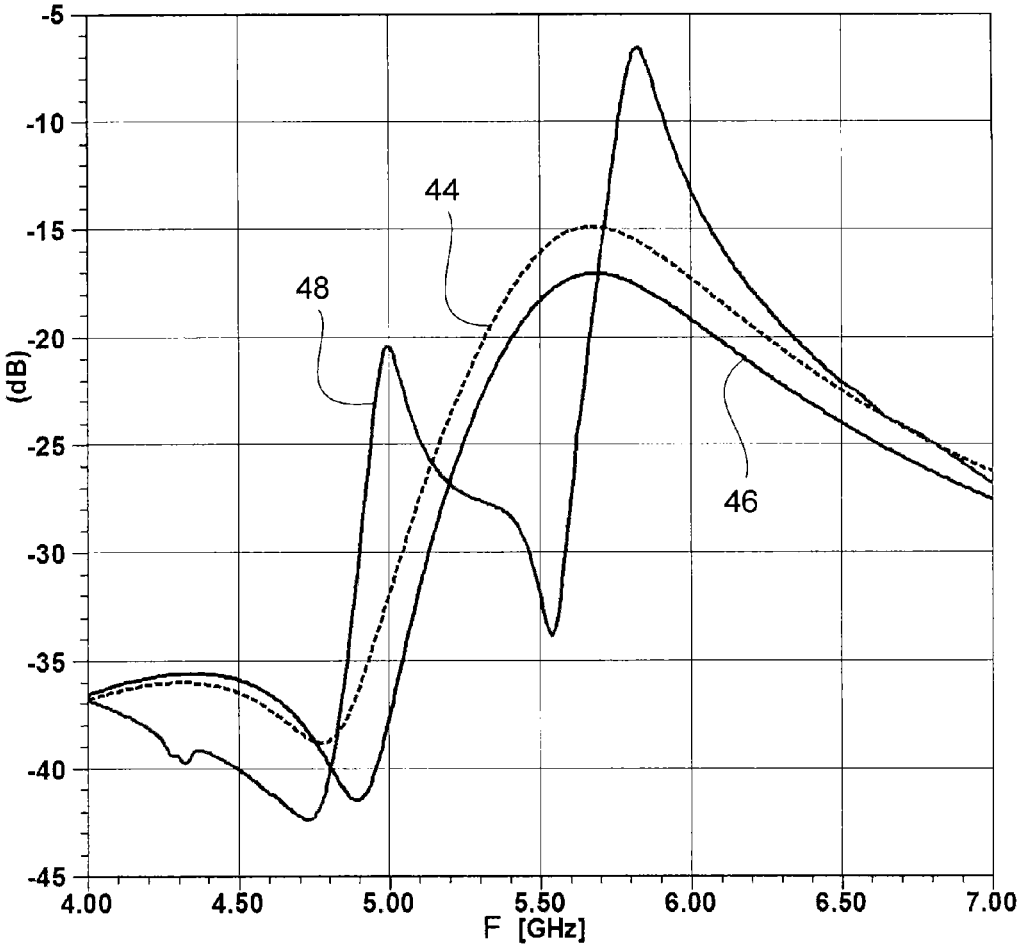
FIG. 8 illustrates coupling curves between antennas of the transmission/receiving systems in FIGS. 6 and 7 according to the transmission/receiving frequency of the antennas.

FIG. 8 illustrates coupling curves 44, 46 and 48 between the planar antennas of the transmission/receiving systems in FIGS. 6 and 7 for a frequency band ranging from 4 to 7 GHz.

More specifically, the curve 44 exhibits the coupling level in dB of the transmission/receiving system in FIG. 6 in the absence of disruption device such as the device 10. This transmission/receiving system has a resonance frequency $f_r$ at approximately 5.5 GHz and coupling of approximately −16 dB at this resonance frequency $f_r$.

The curve 46 exhibits the coupling level in dB of the transmission/receiving system in FIG. 6 in the case whereby the metamaterial structure 12 with no interconnection network is positioned in the zone having the width D between the two planar antennas 30 and 32 of the system. As can be seen in the curve 46, the presence of the metamaterial structure 12 between the planar antennas 30 and 32 makes it possible to reduce the coupling thereof by approximately 2 dB at the frequency of 5.5 GHz.

The curve 48 exhibits the coupling level in dB of the transmission/receiving system in FIG. 7 in the case whereby the disruption device 10 according to the invention is positioned in the zone having the width D between the two planar antennas 30 and 32 of the system. As can be seen in the curve 48, the coupling between the planar antennas 30 and 32 at the resonance frequency $f_r$ of 5.5 GHz is in this case approximately −32 dB, indicating that the presence of this device 10, with phase shifts ($\Phi_1$, $\Phi_2$, $\Phi_3$) having the values (300°, 300°, 45°) respectively, makes it possible to reduce the coupling of the planar antennas 30 and 32 by 14 dB in relation to the presence of the metamaterial structure 12 with no network for interconnecting the conductive elements to each other.

Figure 9:
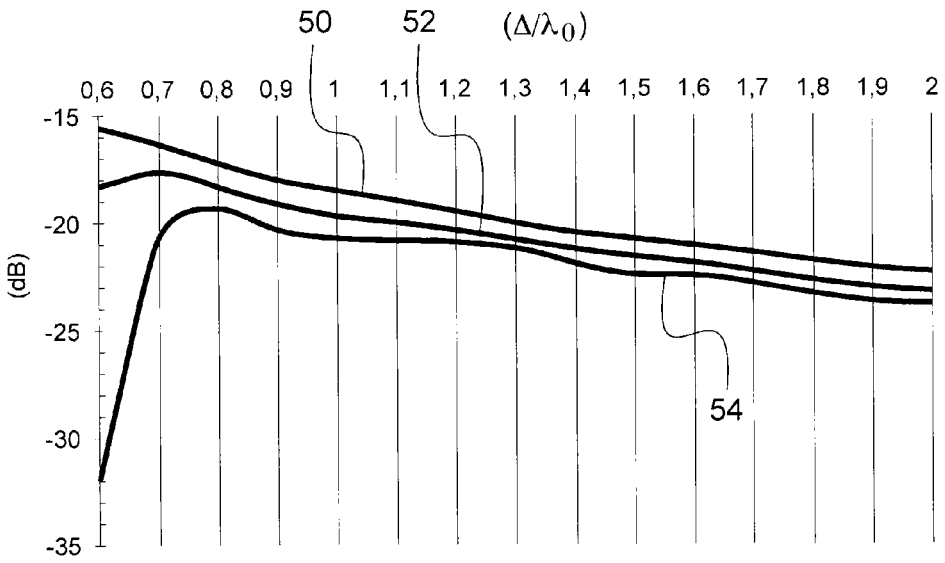
FIG. 9 illustrates coupling curves between antennas of the transmission/receiving systems in FIGS. 6 and 7 according to the distance between the antennas.

FIG. 9 illustrates coupling curves 50, 52 and 54 between the planar antennas 30 and 32 of the transmission/receiving systems in FIGS. 6 and 7 according to the distance Δ between these two antennas normalized in relation to the wavelength $\lambda_0$ and for a frequency of 5.5 GHz.

More specifically, the curve 50 exhibits the coupling level in dB of the transmission/receiving system in FIG. 6 in the absence of a disruption device such as the device 10.

The curve 52 exhibits the coupling level in dB of the transmission/receiving system in FIG. 6 in the case whereby a metamaterial structure 12 with no interconnection network is positioned in the zone having the width D between the two planar antennas 30 and 32 of the system.

The curve 54 exhibits the coupling level in dB of the transmission/receiving system in FIG. 7 in the case whereby the disruption device 10 according to the invention is positioned in the zone having the width D between the two planar antennas 30 and 32 of the system.

The three curves are represented for distances Δ between antennas included in the range from $0.6\lambda_0$ to $2\lambda_0$. In the specific case of the curve 54, for each of these distances, the coupling level in dB is the optimal level obtained for a particular combination of values of the phase shifts $\Phi_1$, $\Phi_2$, $\Phi_3$.

By way of example, the table below illustrates the values of the phase shifts $\Phi_1$, $\Phi_2$, $\Phi_3$ suitable for optimizing decoupling between the antennas of the preceding system for distances in the range from $0.6\lambda_0$ to $2\lambda_0$:

| $\Delta/\lambda_0$ | ($\Phi_1$, $\Phi_2$, $\Phi_3$) |
|---|---|
| 0.6 | (300°, 300°, 45°) |
| 0.7 | (100°, 80°, 60°) |
| 0.8 | (260°, 260°, 270°) |
| 0.9 | (260°, 260°, 255°) |
| 1 | (260°, 260°, 255°) |

-continued

| $\Delta/\lambda_0$ | ($\Phi_1$, $\Phi_2$, $\Phi_3$) |
|---|---|
| 1.1 | (260°, 260°, 240°) |
| 1.2 | (260°, 260°, 240°) |
| 1.3 | (260°, 260°, 240°) |
| 1.4 | (0°, 45°, 60°) |
| 1.5 | (240°, 220°, 45°) |
| 1.6 | (225°, 0°, 30°) |
| 1.7 | (260°, 260°, 255°) |
| 1.8 | (270°, 225°, 0°) |
| 1.9 | (260°, 260°, 255°) |
| 2 | (260°, 260°, 255°) |

As can be seen in the curve 54, the presence of the disruption device 10 with adjustable phase shifts $\Phi_1$, $\Phi_2$, $\Phi_3$ makes it possible to obtain optimal combinations of values of these phase shifts $\Phi_1$, $\Phi_2$, $\Phi_3$ for each distance Δ and thus further reduce the coupling between the antennas 30 and 32 in relation to the curves 50 and 52, for all distances within the range of distances from $0.6\lambda_0$ to $2\lambda_0$.

Figure 10:
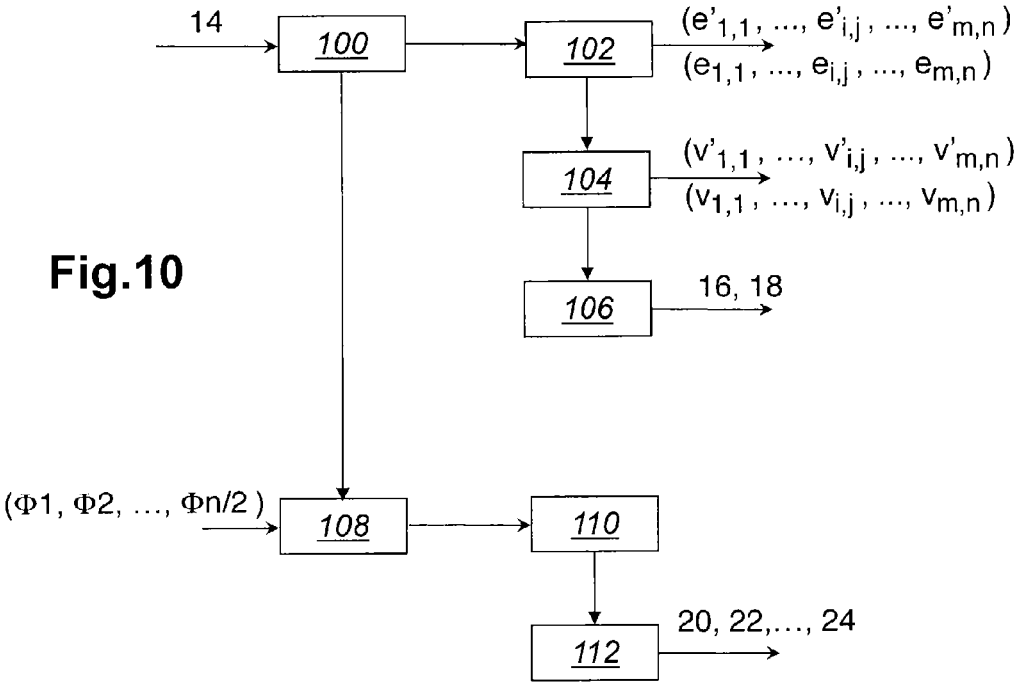
FIG. 10 illustrates the successive steps of a method for producing an electromagnetic wave propagation disruption device, according to one embodiment of the invention.

The successive steps of a method for producing the disruption device 10 in FIG. 1 will now be detailed with reference to FIG. 10.

This production method comprises a first step 100 for arranging on the substrate 14 a plurality of conductive elements separated from each other.

More specifically, during a first substep 102 of the first step 100, two layers of conductive elements $e'_{1,1}, \ldots, e'_{i,j}, \ldots, e'_{m,n}$ and $e_{1,1}, \ldots, e_{i,j}, \ldots, e_{m,n}$ are vertically overlaid (i.e. along the direction z) and arranged on the top face of the substrate 14.

During a second substep 104 of the first step 100, a set of metallic vias $v_{1,1}, \ldots, v_{i,j}, \ldots, v_{m,n}$ and $v'_{1,1}, \ldots, v'_{i,j}, \ldots, v'_{m,n}$ are formed in the substrate 14, passing through the entire thickness thereof.

During a third substep 106 of the first step 100, a ground plane 16 with holes 18 formed facing the metallic through vias is defined on the bottom face of the substrate 14.

During a second step 108, at least some of the conductive elements $e'_{1,1}, \ldots, e'_{i,j}, \ldots, e'_{m,n}$ and $e_{1,1}, \ldots, e_{i,j}, \ldots, e_{m,n}$ are electrically interconnected using a plurality of interconnection networks, for example the interconnection networks 20, 22, 24 described above, these interconnection networks not being electrically connected to each other.

More specifically, during a first substep 110 of the second step 108, on the basis of the predetermined optimal values of the phase shifts $\Phi_1, \Phi_2, \ldots, \Phi_{n/2}$ for a transmission/receiving system operating at a resonance frequency $f_r$, at least two interconnection networks are dimensioned differently from each other to generate phase shifts $\Phi_1, \Phi_2, \ldots, \Phi_{n/2}$ between the conductive elements interconnected thereby.

Finally, during a second substep 112 of the second step 108, the conductive elements in question are effectively connected to each other, for example in pairs and according to a linear topology as illustrated in FIGS. 1 and 7, using the lower ends of the metallic vias thereof as access ports to the power supply points of the interconnection networks.

As also mentioned in the examples of embodiments described above, the phase shifts $\Phi_1, \Phi_2, \ldots, \Phi_{n/2}$ characterizing the interconnection networks determine the length of the transmission lines used for connecting the conductive elements to each other for a given transmission/receiving system.

In one alternative embodiment, at least some of these interconnection networks are equipped with adjustable phase shift devices well known to those skilled in the art, for example diodes, for interconnecting the conductive elements to each other. This makes it possible to adjust the phase shifts according to the application to be optimized by merely varying the behavior of the active or passive elements used while retaining the metamaterial structure 12 and without needing to modify the length of the transmission lines.

It clearly appears that an electromagnetic wave propagation disruption device such as that described above makes it possible to enhance the decoupling level between planar antennas without increasing the size of the transmission/receiving system including such antennas regardless of the resonance frequency of the system and the distance between the antennas. Modifying the behavior of an EBG structure after the production thereof can thus be envisaged by interconnecting the conductive elements using transmission lines with different phase shifts. Furthermore, the use of adjustable phase shift devices for making these interconnections makes it possible to adapt the behavior of the same electromagnetic wave propagation disruption device to different transmission/receiving systems.

It should be noted that the invention is not limited to the embodiments described above. It will be obvious to those skilled in the art that various modifications may be made to the embodiments described above, in the light of the teaching disclosed herein. In the claims hereinafter, the terms used should not be interpreted as limiting the claims to the features in the examples of embodiments described above, but should be interpreted to include any equivalents which can be envisaged by those skilled in the art by applying their general knowledge to the implementation of the teaching disclosed herein.

The invention claimed is:

1. An electromagnetic wave propagation disruption device with a metamaterial structure, comprising:

a plurality of conductive elements separated from each other and arranged on a top face of a substrate;

a plurality of interconnection networks electrically interconnecting at least some of said conductive elements, wherein the interconnection networks are not electrically connected to each other, and wherein at least two of said interconnection networks are dimensioned differently to each other, such that distances between interconnected conductive elements are different from one interconnection network to another interconnection network of said at least two of said interconnection networks, to generate phase shifts between the conductive elements interconnected thereby, different from one of said interconnection networks to said another interconnection network;

a ground plane positioned on a bottom face of the substrate with holes formed in the ground plane; and a set of metallic vias formed in the substrate and passing through an entire thickness thereof, each of said metallic vias comprising an upper end in contact with one of the conductive elements and a lower end arranged facing one of the holes formed in the ground plane, with no electrical contact with the ground plane but with an electrical contact with one of the interconnection networks.

2. The electromagnetic wave propagation disruption device as claimed in claim 1, wherein at least some of said interconnected networks include adjustable phase shift devices configured to connect the conductive elements to each other.

3. The electromagnetic wave propagation disruption device as claimed in claim 1, wherein the conductive elements are distributed on the substrate in an array along m rows and n columns, n being an even number, each interconnection network interconnecting two conductive elements of the same i-th row positioned on the $$\left(\frac{n}{2}-j\right)\text{-th and }\left(\frac{n}{2}+1+j\right)\text{-th}$$

columns, where, for each interconnection network, i adopts one of the values from the range [1,m] and j adopts one of the values from the range $$\left[0,\ \frac{n}{2}-1\right].$$

4. The electromagnetic wave propagation disruption device as claimed in claim 1, wherein the lower ends of the metallic vias in contact with the interconnected conductive elements form access ports to power supply points to which the interconnection networks are connected.

5. The electromagnetic wave propagation disruption device as claimed in claim 1, wherein the metamaterial structure includes two overlaid layers of conductive elements arranged on the top face of the substrate, each of said layers including a plurality of conductive elements separated from each other and distributed in an array along m rows and n columns, said two layers being separated from each other along a perpendicular direction to the top face of the substrate by a predetermined distance, the conductive elements of the first layer being arranged in a staggered fashion relative to the conductive elements of the second layer.

6. The electromagnetic wave propagation disruption device as claimed in claim 1, wherein each of the conductive elements has any of the shapes of the set consisting of a square shape, a rectangular shape, a spiral shape, a fork shape, a Jerusalem cross shape and a dual Jerusalem cross shape known as a UC-EBG shape.

7. The electromagnetic wave propagation disruption device as claimed in claim 1, wherein said plurality of interconnection networks has any of the topologies from the set consisting of a linear topology, a star topology, a radial topology and a tree topology.

8. An electromagnetic wave transmission/receiving system including at least two antennas between which at least one electromagnetic wave propagation disruption device as claimed in claim 1 is arranged.

9. A method for producing an electromagnetic wave propagation disruption device with a metamaterial structure, comprising:

arranging a plurality of conductive elements separated from each other on a top face of a substrate;

electrically interconnecting at least some of said conductive elements using a plurality of interconnection networks, said interconnection networks not being electrically connected to each other;

dimensioning the interconnection networks, wherein at least two of said interconnection networks are dimensioned differently to each other, such that distances between interconnected conductive elements are different from one interconnection network to another interconnection network of said at least two of said interconnection networks, to generate phase shifts between the conductive elements interconnected thereby, different from one of said interconnection networks to said another interconnection network;

arranging a ground plane on a bottom face of the substrate with holes formed in the ground plane; and forming a set of metallic vias in the substrate passing through an entire thickness thereof, each of said metallic vias comprising an upper end in contact with one of the conductive elements and a lower end arranged facing one of the holes formed in the ground plane, with no electrical contact with the ground plane but with an electrical contact with one of the interconnection networks.

10. The method for producing an electromagnetic wave propagation disruption device with a metamaterial structure according to claim 9, wherein at least some of said interconnected networks include adjustable phase shift devices configured to connect the conductive elements to each other.

11. The method for producing an electromagnetic wave propagation disruption device with a metamaterial structure according to claim 9, wherein the conductive elements are distributed on the substrate in an array along m rows and n columns, n being an even number, each interconnection network interconnecting two conductive elements of the same i-th row positioned on the $$\left(\frac{n}{2}-j\right)\text{-th and }\left(\frac{n}{2}+1+j\right)\text{-th}$$

columns, where, for each interconnection network, i adopts one of the values from the range [1,m] and j adopts one of the values from the range $$\left[0,\frac{n}{2}-1\right].$$

12. The method for producing an electromagnetic wave propagation disruption device with a metamaterial structure according to claim 9, wherein the lower ends of the metallic vias in contact with the interconnected conductive elements form access ports to power supply points to which the interconnection networks are connected.

13. The method for producing an electromagnetic wave propagation disruption device with a metamaterial structure according to claim 9, wherein the metamaterial structure includes two overlaid layers of conductive elements arranged on the top face of the substrate, each of said layers including a plurality of conductive elements separated from each other and distributed in an array along m rows and n columns, said two layers being separated from each other along a perpendicular direction to the top face of the substrate by a predetermined distance, the conductive elements of the first layer being arranged in a staggered fashion relative to the conductive elements of the second layer.

14. The method for producing an electromagnetic wave propagation disruption device with a metamaterial structure according to claim 9, wherein each of the conductive elements has any of the shapes of the set consisting of a square shape, a rectangular shape, a spiral shape, a fork shape, a Jerusalem cross shape and a dual Jerusalem cross shape known as a UC-EBG shape.

15. The method for producing an electromagnetic wave propagation disruption device with a metamaterial structure according to claim 9, wherein said plurality of interconnection networks has any of the topologies from the set consisting of a linear topology, a star topology, a radial topology and a tree topology.

* * * * *